US009901786B2

(12) United States Patent
Krysiak et al.

(10) Patent No.: US 9,901,786 B2
(45) Date of Patent: Feb. 27, 2018

(54) BASKETBALL HAVING GROOVED SEAMS

(71) Applicant: Wilson Sporting Goods Co., Chicago, IL (US)

(72) Inventors: Kevin L. Krysiak, Palantine, IL (US); William R. Woessner, Imperial, PA (US); Bradley L. Gaff, Chesterton, IN (US); Robert T. Thurman, Plainfield, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 61 days.

(21) Appl. No.: 14/798,632

(22) Filed: Jul. 14, 2015

(65) Prior Publication Data

US 2015/0314170 A1 Nov. 5, 2015

Related U.S. Application Data

(62) Division of application No. 13/598,732, filed on Aug. 30, 2012, now Pat. No. 9,114,286.

(60) Provisional application No. 61/530,487, filed on Sep. 2, 2011.

(51) Int. Cl.
*A63B 41/08* (2006.01)
*A63B 41/02* (2006.01)

(52) U.S. Cl.
CPC ..... *A63B 41/08* (2013.01); *A63B 41/02* (2013.01)

(58) Field of Classification Search
CPC .. A63B 41/08; A63B 2243/0037; A63B 41/00
See application file for complete search history.

(56) References Cited

U.S. PATENT DOCUMENTS

| | | | |
|---|---|---|---|
| 1,240,866 | A | 9/1917 | Miller |
| 2,182,052 | A | 12/1939 | Reach |
| 2,182,053 | A | 12/1939 | Reach |
| 2,219,078 | A | 10/1940 | Reach |
| 2,245,115 | A | 6/1941 | Reach |
| 3,256,019 | A | 6/1966 | Barton |
| 3,475,027 | A | 10/1969 | Henderson |
| 3,508,750 | A | 4/1970 | Henderson |
| 3,512,777 | A | 5/1970 | Henderson |
| 3,948,518 | A | 4/1976 | Tebbetts, Jr. |
| 4,000,894 | A | 4/1977 | Butzen |
| 4,570,931 | A | 8/1986 | Martin |
| 5,320,345 | A | 6/1994 | Lai et al. |
| 5,681,233 | A | 10/1997 | Guenther et al. |
| 5,888,157 | A | 3/1999 | Guenther et al. |
| 5,931,752 | A | 8/1999 | Guenther et al. |

(Continued)

*Primary Examiner* — Steven Wong
(74) *Attorney, Agent, or Firm* — Terence P. O'Brien

(57) ABSTRACT

A basketball including a carcass, cover panels, and cover strips. The carcass has an outer surface defining a first set of channels and cover panels regions between the first set of channels. The panels are respectively positioned over the panel regions and are spaced apart from each other. The strips are positioned over the channels. The strips have inner and outer surfaces extending between first and second sidewalls. The strips have a thickness that is measured radially from a centerpoint from the inner to the outer surface, and a width that is measured from the first to the second sidewall. At least one groove is formed into the outer surface. The groove has a width that extends between 20 to 70 percent of the width of the strip and has a maximum depth from the outer surface that is at least 50 percent of the maximum thickness of the strip.

11 Claims, 5 Drawing Sheets

(56) References Cited

U.S. PATENT DOCUMENTS

| | | | |
|---|---|---|---|
| 6,024,661 | A | 2/2000 | Guenther et al. |
| 6,123,633 | A | 9/2000 | Guenther et al. |
| D442,656 | S | 5/2001 | Nagase |
| 6,422,961 | B1 | 7/2002 | Feeney |
| 6,506,135 | B2 | 1/2003 | Ou |
| D483,424 | S | 10/2003 | Lowinger |
| 6,634,970 | B2 | 10/2003 | Jiminez |
| D484,205 | S | 12/2003 | Ota |
| 6,685,584 | B2 | 2/2004 | Jin et al. |
| D516,642 | S | 3/2006 | Swiszcz et al. |
| D544,053 | S | 6/2007 | Krysiak |
| D544,931 | S | 6/2007 | Laliberty et al. |
| 7,300,369 | B2 | 11/2007 | Krysiak et al. |
| 7,585,236 | B2 | 9/2009 | Krysiak |
| D605,240 | S | 12/2009 | Gibson |
| 7,892,120 | B2 | 2/2011 | Krysiak |
| 7,909,715 | B2 | 3/2011 | Krysiak |
| D653,808 | S | 2/2012 | Gelin |
| 8,152,664 | B2 | 4/2012 | Madore et al. |
| 8,251,846 | B2 | 8/2012 | Krysiak |
| 8,460,136 | B2 | 6/2013 | Krysiak |
| D685,868 | S | 7/2013 | Krysiak et al. |
| D686,678 | S | 7/2013 | Krysiak et al. |
| 8,740,734 | B2 | 6/2014 | Krysiak |
| 9,520,877 | B2 | 12/2016 | Meinerzhagen et al. |
| 2004/0259670 | A1 | 12/2004 | Chang |

BASKETBALL HAVING GROOVED SEAMS

RELATED U.S. APPLICATION DATA

The present application is a divisional application of U.S. patent application Ser. No. 13/598,732 filed on Aug. 30, 2012, which claims the benefit of the filing date under 35 U.S.C. §119(e) of U.S. Provisional Patent Application Ser. No. 61/530,487, filed on Sep. 2, 2011, which is hereby incorporated by reference in its entirety.

FIELD OF THE INVENTION

The present invention relates generally to sport game balls. In particular, the present invention relates to a basketball having an improved seam construction to improve the playability of the basketball.

BACKGROUND OF THE INVENTION

Game balls for sports such as basketballs, footballs, soccer balls, volleyballs, rugby balls, baseballs and softballs are well known. Many game balls, such as basketballs, typically include an inflatable bladder covered with a layer of windings and encased in a layer of elastomeric material, typically molded in a carcass forming mold to form the carcass of the ball. One or more additional layers of material, such as a cover or padding may be placed over portions, or all, of the outer surface of the carcass to form the basketball. Covers of game balls are commonly formed of rubber, leather, synthetic leather or a polymeric material.

Basketballs typically include an arrangement of interconnected seams or channels formed into the outer surface of the basketball. The seams typically are arranged to define eight to twelve cover regions in the outer surface of the basketball. The seams are typically recessed into the outer surface of the basketball, and the seams can facilitate a player's ability to grasp, handle, shoot, pass, dribble and otherwise control the ball during play. Many players, if given the time during play, will rotate the ball in their hands prior to shooting so that they can align one or more of their fingertips with one or more of the seams. Such alignment can facilitate the player's ability to shoot the ball and to impart a spin on the ball upon shooting. Other players rely on or utilize the recessed seams of a basketball to facilitate one-handed grasping, or overall control, of the basketball.

Although existing seam construction provide benefits to players, a continuing need exists to provide a seam construction that will significantly improve the grippability, and playability of a game ball. Additionally, there is a continuing need for a basketball that can be more readily grasped and manipulated by a player with a single hand or with both hands. What is needed is a basketball that improves the player's ability to easily grasp, handle, pass, shoot, dribble and otherwise control the ball during use without radically departing from the ball's traditional design. There is also an ever present need to improve the feel of a basketball during play. Further, a continuing need also exists to produce a game ball with an improved aesthetic.

SUMMARY OF THE INVENTION

The present invention provides a generally spherical basketball defining a center point. The basketball includes a carcass, a plurality of cover panels having peripheral edges, and a plurality of elongated cover strips. The carcass has an outer surface defining a first set of channels and a plurality of cover panels regions between the first set of channels. The cover panels are respectively positioned over the plurality of cover panel regions and are spaced apart from each other. The cover strips are positioned over the first set of channels and between the peripheral edges of the spaced-apart cover panels. The cover strips have inner and outer surfaces extending between first and second side walls. The cover strips have a thickness that is measured in a direction extending radially from the center point from the inner surface to the outer surface of the cover strip, and a width that is measured from the first side wall to the second side wall. At least one narrow elongate groove is formed into the outer surface of the cover strips. The groove has a width that extends between the range of 20 to 60 percent of the width of the cover strip and having a maximum depth from the outer surface of the cover strip that is at least 50 percent of the maximum thickness of the cover strip.

According to a principal aspect of a preferred form of the invention, a generally spherical basketball defining a center point. The basketball includes a carcass and a plurality of cover panels. The carcass has an outer surface that includes a set of outwardly extending ribs and a plurality of cover panels regions between the ribs. The ribs include an elongated central surface extending between first and second rib side walls. The ribs have a rib height that is measured in a direction extending radially from the center point from a first point positioned at the same radial dimension as the outer surface of the cover panel region to the central surface. The cover panels are respectively positioned over the plurality of cover panel regions. The central surface of the ribs and the outer surface of the cover panels collectively form the outer surface of the basketball. The central surface has a central surface width defined by the exposed distance from the first rib side wall to the second rib side wall. At least one narrow elongate channel is formed into the central surface of the rib. The channel has a width that extends between the range of 20 to 60 percent of the width of the central surface of the rib and a maximum depth that is at least 60 percent of the maximum rib height. The central surface is generally smooth and non-pebbled.

According to another preferred aspect of the invention, a generally spherical basketball defining a center point. The basketball includes a carcass and a plurality of cover panels. The carcass includes a bladder, a layer of windings surrounding the bladder, at least one layer of sponge rubber substantially surrounding the layer of windings, and a plurality of seam strips positioned in a pattern over the one or both of the layers of windings and the at least one layer of sponge rubber. The carcass is molded such that the plurality of seam strips define a set of outwardly extending ribs. The outer surface of the carcass defines a plurality of cover panel regions between the ribs. The ribs include an elongated central surface extending between first and second rib side walls. The ribs have a rib height that is measured in a direction extending radially from the center point from a first point positioned at the same radial dimension as the outer surface of the cover panel region to the central surface. The cover panels are respectively positioned over the plurality of cover panel regions and at least a portion of the seam strips. The central surface of the ribs and the outer surface of the cover panels collectively form the outer surface of the basketball. The central surface has a central surface width defined by the exposed distance from the first rib side wall to the second rib side wall. At least one narrow elongate channel is formed into the central surface of the rib. The channel has a width that extends between the range of 20 to 60 percent of the width of the central surface of the rib and a maximum depth that is at least 70 percent of the maximum rib height.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
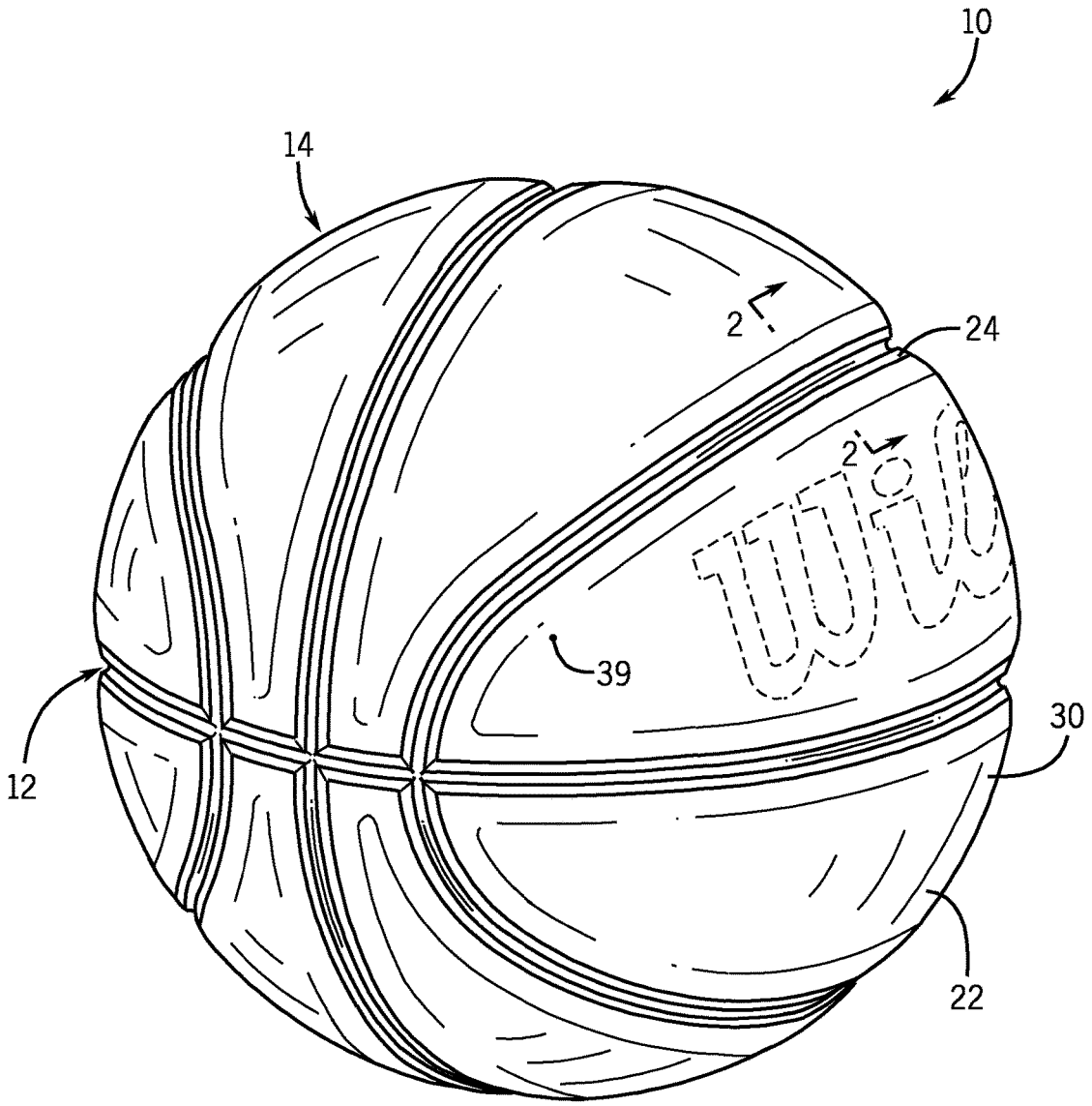
FIG. 1 is a front side perspective view of a generally spherical basketball in accordance with a preferred embodiment of the present invention.
Figure 2:
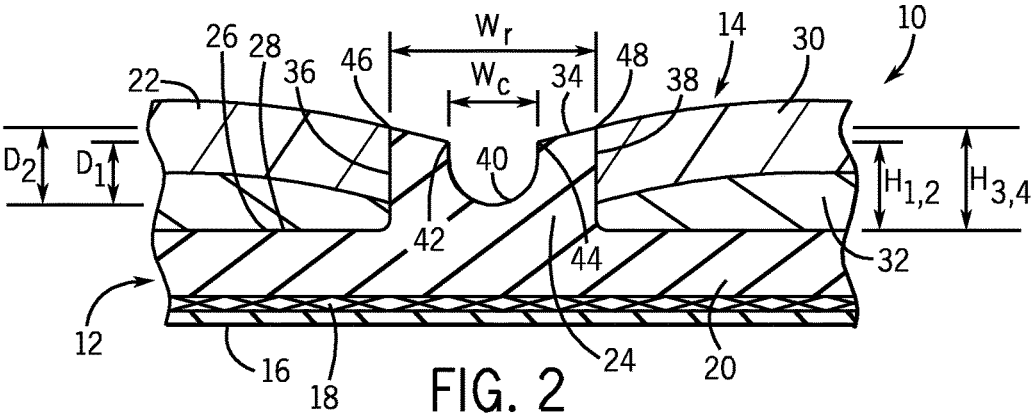
FIG. 2 is a sectional view of the basketball of FIG. 1 taken along line 2-2 of FIG. 1.

Referring to FIGS. 1 and 2, a basketball is indicated generally at 10. The basketball 10 is one example of a game ball. The present application is directly applicable to other games balls, including, for example, footballs, rugby balls, soccer balls, and volleyballs.

The basketball 10 is a generally spherical inflatable object. The basketball 10 is preferably includes a carcass 12 and a cover assembly 14. The carcass 12 is a combination of ball components that are molded in a carcass-forming mold to produce an inflatable ball structure. In one preferred embodiment, the carcass 12 includes a bladder 16, a layer of windings 18 and at least one layer of elastomeric material 20. The cover assembly 14 includes a plurality of cover attachment pieces. In one preferred embodiment, the cover assembly 14 includes a plurality of cover panels 22. The cover panels 22 are preferably spaced apart by a set of channels or a set of outwardly extending ribs 24.

The bladder 16 of the carcass 12 is an inflatable air tube preferably having a generally spherical shape. The bladder 16 is disposed within the windings 18. The bladder 16 enables the basketball 10 to retain a predetermined amount of air thereby achieving the desired air pressure within, or firmness to, the basketball 10. The bladder 16 is typically made of latex, butyl rubber or other suitable material. The bladder 16 includes a valve (not shown) that extends through the windings 18, the layer of elastomeric material 20 and the cover assembly 14 for access by a user.

The layer of windings 18 of the carcass 12 includes one or more elongate threads, which are wound around, or applied to, the bladder 16. The threads form the layer of windings 14 that reinforces the bladder 16 and retains the generally spherical shape of the bladder 16. The threads of the winding 18 are formed of a high tensile strength material, preferably nylon. In alternative embodiments, the thread can be a textile, a wire, or other conventional thread material. In a particularly preferred embodiment, the layer of windings 18 is comprised of 2100 meters of 210 denier Nylon thread. In an alternative embodiment, the basketball can be formed without a layer of windings. In another alternative preferred embodiment, the layer of windings can be formed through one or more segments of adhesive tape, or similar material.

The layer of elastomeric material 20 of the carcass 12 is a generally spherical body disposed over the layer of windings 18. In a preferred embodiment, the layer of elastomeric material 20 is formed by placing a plurality of segments of elastomeric material onto an outer surface of the windings 18 and then molding the segments in a carcass-forming mold over the wound bladder 16 to produce a uniform spherical layer of elastomeric material. The layer of elastomeric material 20 can also be injected, or otherwise inserted, within a carcass forming mold. It is common for a portion of the layer of elastomeric material 20 to impregnate, bond to, or otherwise engage the layer of windings 18. The layer of elastomeric material 20 is, preferably, a sponge rubber. Alternatively, the carcass 16 can be made of other materials such as latex, a butyl rubber, a natural rubber, a synthetic polymeric plastic material, or other elastomeric materials. In another alternative embodiment, the layer of elastomeric material 20 can be a multi-layered body including one or more layers of fabric or elastomeric material.

In one preferred embodiment, the carcass 12 is placed into a carcass-forming mold. The carcass forming mold includes an arrangement of recesses, grooves, and/or projections to form the shape and structure of an outer surface 26 of the carcass 12, after the carcass 12 is molded and cured. In one preferred embodiment, the carcass forming mold produces the set of outwardly extending ribs 24 on the outer surface 26. The set of ribs 24 defines a plurality of cover attachment regions 28 about the outer surface 26 of the carcass 12. Accordingly, the set of ribs 24 are integrally formed with the layer of elastomeric material 20 and are part of the carcass 12. In one preferred embodiment, the carcass 12 defines at least two, and less than or equal to sixteen, cover attachment regions 28. In particularly preferred embodiments, the carcass defines eight, ten or twelve cover attachment regions 28. Each cover attachment region 28 is configured to receive at least one cover panel 22. In alternative embodiments, the carcass can be formed without the set of ribs. The first set of ribs 24 can define a pattern resembling the pattern of channels or ribs found on a conventional basketball. Alternatively, other pattern layouts can also be used.

The cover assembly 14 is preferably comprised of the plurality of cover panels 22. In one preferred embodiment, the cover assembly 14 includes at least two cover panels 22 and less than or equal to sixteen cover panels 22. In particularly preferred embodiments, the cover assembly 14 includes eight, ten or twelve cover panels 22. The cover panels 22 are single or multi-layered sheets of material that are coupled to the cover attachment regions 28 of the carcass 12. Preferably, the cover panels 22 are laminated to the cover attachment regions 28 of the carcass 12. Alternatively, the cover panels 22 can be attached to the carcass 12 by other means, such as, for example, stitching, molding, pressing, bonding, and combinations thereof. The cover panels 22 preferably include peripheral edges that extend to the ribs 24. The cover assembly 14 is configured for impact with one or more playing surfaces and for contact with players. In an alternative preferred embodiment, the cover assembly 14 can be connected directly to the bladder 12 or to the layer of windings 14.

The cover panels 22 preferably include an outer layer 30 coupled to a backing 32. The outer layer 30 is formed or applied to the backing 32 such that a portion of the outer layer 30 impregnates, extends into, or otherwise engages the backing 32. Alternatively, the outer layer 30 can be attached to the backing 32 through an adhesive, bonding, stitching, or other conventional means. The outer layer 30 is preferably formed of a wear-resistant, resilient material having a high coefficient of friction value (or a high level of grippability). The material used to produce the outer layer 30 can be a natural rubber, a butyl rubber, natural leather, synthetic leather, a polyurethane, a thermoplastic material, a thermoset material, or other synthetic polymeric materials.

The backing 32 is configured to increase the tensile strength of the cover panels 22. The backing 32 is made of a soft material, preferably a felt-like fabric. Alternatively, the backing 32 can be formed of other materials, such as, for example, other woven or unwoven fabrics, plastic, an elastomer, a rubber, and combinations thereof. The backing 32 is preferably configured to contact the outer surface 26 of the carcass 12. In an alternative preferred embodiment, the cover panels 22 can be formed without a backing. In a particularly preferred embodiment, peripheral regions of the backing 32 (and/or the outer layer 30) can be skived (tapered or thinned out) to produce a recess in the outer surface of the basketball 10 near the set of ribs 24. In alternative preferred embodiments, the thickness of the cover panel can remain generally constant over the entire cover panel.

Referring to FIG. 2, in a preferred embodiment, the set of ribs 24 outwardly extend from the layer of elastic material 20 projecting from the outer surface 26 of the layer 20 at the cover panel region 28. Each of the ribs 24 includes an elongated central surface 34 extending between first and second side walls 36 and 38. A narrow, elongate channel 40 is formed into the central surface 34 of the rib 24. The ribs 24 have a rib height that is measured in a direction extending radially from a center point 39 (see FIG. 1) of the ball 10 from a first point positioned at the same radial dimension as the outer surface 26 of the cover panel region 28 to the corresponding point on the central surface 34. For example, the height of the rib 24 at the first and second side walls 36 and 38 is third height, $H_3$, and fourth height, $H_4$, and the height of the rib at the edges of the channel 40 are first and second heights, $H_1$ and $H_2$, respectively. In one preferred embodiment, as shown in FIG. 2, the heights $H_3$ and $H_4$ are greater than the heights $H_1$ and $H_2$ thereby producing slopes in the central surface 34 on either side of the channel 40. The width of the rib 24, $W_r$, is the distance from the first side wall 36 to the second side wall 38. The width of the channel 40, $W_e$, is preferably greater than 20 and less than 60 percent of the total width of the rib 24, $W_r$. The channel 40 preferably extends along a substantial length of the set of ribs 24. In one preferred embodiment, the channel 40 can be one continuous channel or a series of channels, and the channels 40 have a collective total length that is at least 20 percent of the total collective length of ribs 24 extending about the outer surface 26 of the carcass 12. In another preferred embodiment, the set of ribs 24 forms a collection of ribs forming a pattern, such as the pattern of a conventional basketball, and at least one of the channels 40 is formed on each of the ribs 24 of the set. In another preferred embodiment, the channel(s) 40 extend along approximately the entire length of the set of ribs 24. In other preferred embodiments, the channels 40 can be formed along the ribs 24 in a spaced apart manner or pattern. For example, each channel 40 can have a length of 2 inches and are defined in the ribs 24 in an end to end fashion spaced apart by at least 0.5 inch. Other lengths, patterns and amounts of spacing between the plurality of channels formed into the ribs can also be used, and are contemplated in the present invention.

The channel 40 preferably has a generally U-shape when viewed from a transverse cross-sectional view, such as FIG. 2, and a maximum depth, $D_1$, that is at least 60 percent of the height of the rib 24 at first and second upper edges 42 and 44 of the channel 40. The first and second edges 42 and 44 being formed by the upper portion of the channel 40 meeting the central surface 34 of the rib 24. Third and fourth edges 46 and 48 are formed by the first and second side walls 36 and 38 meeting the central surface 34 of the rib 24. In FIG. 2, the maximum height of the rib 24 occurs at the third and fourth edges 46 and 48. Preferably, the depth, $D_2$, is at least 70 percent of the height $H_3$ or $H_4$ of the rib 24 at the third and fourth edges 46 and 48, or the maximum height of the rib 24. The first, second, third and fourth edges 42, 44, 46 and 48 are preferably rounded. In other embodiments the first, second, third and fourth edges can be form non-rounded angled edges. The central surface 34 of the rib 24 is preferably smooth or continuous along the length of the rib 24. In other words, the central surface 34 of the rib 24 (or outermost surface of the rib) is preferably formed without a pebbled texture, without a plurality of pebbles, and without any other plurality of projections, such as protruding grains or ridges. The central surface 34 may be formed as flat or planar, may be formed with a gradual slope or an angled planar shape or may be formed with a slight curvature, as it extends away from the first and second side walls 36 and 38, but the central surface is preferably formed without a plurality of pebbles, grains or projections.

Figure 3:
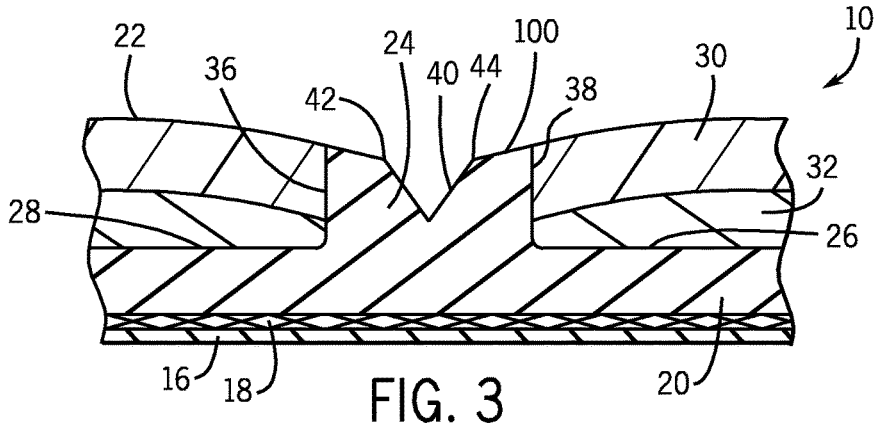
FIGS. 3 through 7 are sectional views of the basketball similar to the sectional view of FIG. 2, but in accordance with alternative preferred embodiments of the present invention.
Figure 4:
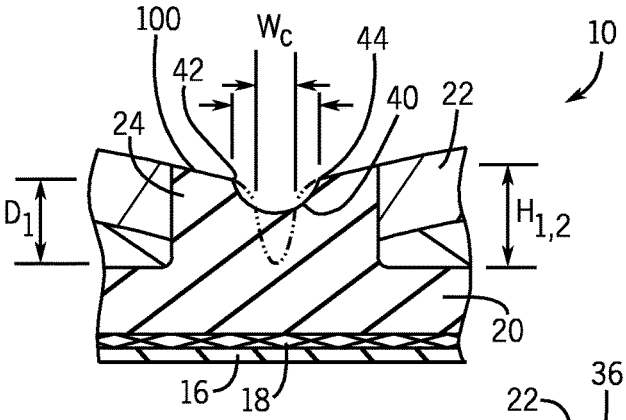
Figure 5:
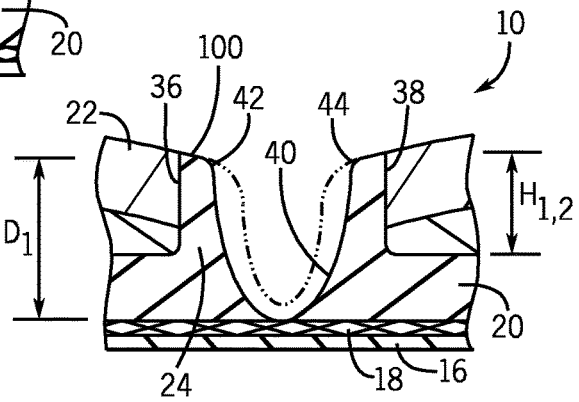
Figure 6:
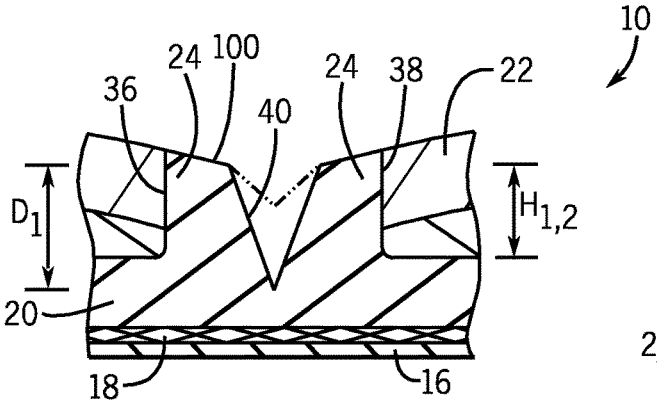

Referring to FIGS. 3 and 6, in an alternative preferred embodiments, the channel 40 can be formed in a generally V-shape when viewed from a transverse cross-sectional view. Referring to FIGS. 3 through 7, the depth, $D_1$, and width, $W_c$, of the channel 40 can vary. The width, $W_c$, can vary from 20 percent to 60 percent of the total width of the rib, $W_r$. The depth, $D_1$, can be at least 60 percent of the rib height $H_1$ or $H_2$. In other preferred embodiment, the depth, $D_1$, can be equal to or greater than the rib height $H_1$ or $H_2$ such that the channel 40 extends into the layer of elastomeric material 20. In one particularly preferred embodiment (see FIG. 5), the depth $D_1$ of the channel 40 can extend entirely through the thickness of the layer of elastomeric material 20 to the windings 18. The width, $W_c$, can be selected from the range of 20 percent to 60 percent of the total width, $W_r$, to provide the best feel and performance improvement to the player for a particular skill level and/or application. The depth, $D_1$, of the channel 40 can also be varied beyond 60 percent of the maximum height $H_3$ or $H_4$. The relatively narrow width (within 20 to 60 percent of the total rib width $W_r$) and the large depth, $D_1$, of the channel (at least 60 percent of the maxim height $H_3$ or $H_4$) provides an improved feel during play and facilitates the players ability to grasp, control, shoot, dribble, and/or pass the ball 10. The narrow, deep channels 70 improve the player's ability to readily grasp the ball and to accurately shoot or pass the ball. The first and second edges 42 and 44 are readily sensed by the player and provide the player with increased control of the ball.

Figure 7:
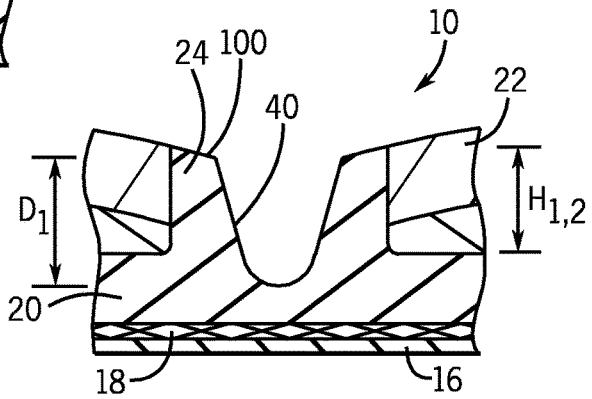

Referring to FIG. 7, in an alternative preferred embodiment, the channel 40 can be substantially filled with a soft, resilient material, such as a cellular foam 98. The cellular foam 98 has a hardness value that is lower (such that the foam 98 is softer) than the material used to form the rib 24. In this manner, the central surface 34 of the rib 24 can retain the appearance of a conventional central surface 34 with a flat surface or slightly recessed surface, such as the recess 100.

Figure 8:
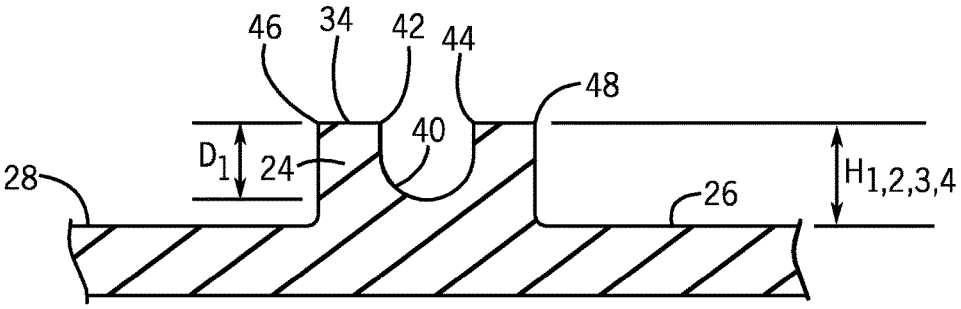
FIGS. 8 and 9 are lateral cross-sectional views of a layer of elastomeric material and outwardly extending rib in accordance with additional alternative preferred embodiments of the present invention.
Figure 9:
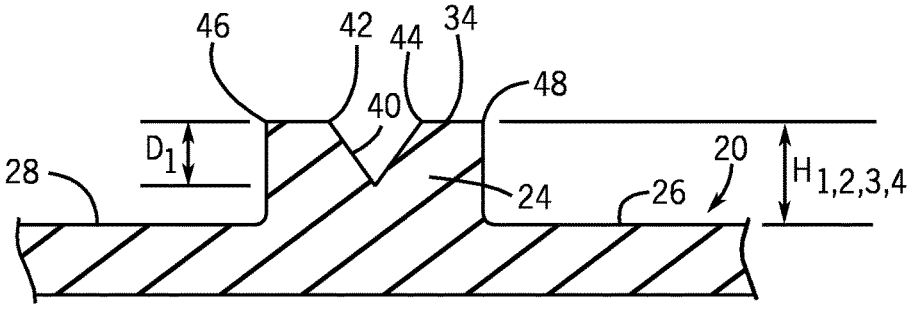

Referring to FIGS. 8 and 9, the rib heights, $H_1$ and $H_2$, measured at the first and second edges 42 and 44 of the channel 40, respectively, can be substantially the same height as the rib height, $H_3$ and $H_4$ measured at the third and fourth edges 46 and 48, respectively. Accordingly, the central surface 34 of the rib 24 can be generally planar and unsloped between the first and third edges 42 and 46 and the second and fourth edges 44 and 48. In other alternative preferred embodiments, the rib heights $H_1$ and $H_2$ can be equal or unequal to the rib heights $H_3$ and $H_4$, and the central surface 34 between the rib heights $H_1$ and $H_3$ and the rib heights $H_2$ and $H_4$ can be sloped, convex, concave or otherwise curved. The channel 40 can be generally U-shaped or generally V-shaped.

Figure 10:
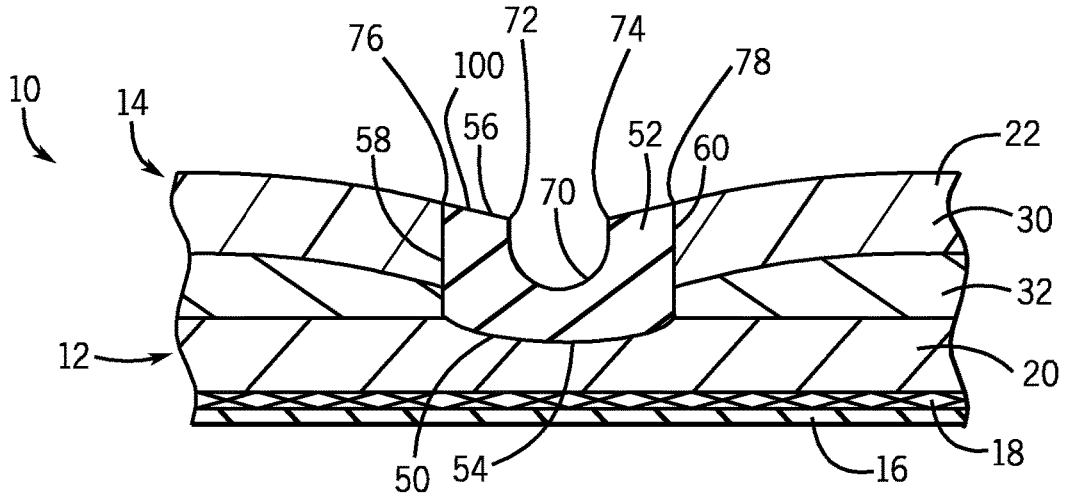
FIGS. 10 through 13 are sectional views of the basketball similar to the sectional view of FIG. 2, but in accordance with additional alternative preferred embodiments of the present invention.

Referring to FIG. 10, an alternative preferred embodiment of the present invention is shown. The layer of elastomeric material 20 can be formed with a first set of channels 50 in the outer surface 26 of the carcass 12. The first set of channels 50 defines the plurality of cover attachment regions 28 about the outer surface 26 of the carcass 12. In one preferred embodiment, the carcass 12 defines at least two, and less than or equal to sixteen, cover attachment regions 28. In particularly preferred embodiments, the carcass defines eight, ten or twelve cover attachment regions 28. Each cover attachment region 28 is configured to receive at least one cover panel 22. The first set of channels 50 can define a pattern resembling the pattern of channels or ribs found on a conventional basketball. Alternatively, other pattern layouts can also be used.

A plurality of elongated cover strips 52 can be positioned over the first set of channels 50 between peripheral edges 54 of the spaced-apart cover panels 22. The cover strips 52 have inner and outer surfaces 54 and 56 extending between first and second sidewalls 58 and 60. In one preferred embodiment, the outer surface 56 of the cover strips 52 preferably includes a pebbled texture, such as the pebbled texture of the outer surface of the cover panel of a conventional basketball. The shape of the pebbles of the pebbled texture can be any raised shape, such as, for example, circular, oval, polygonal, irregular, and combinations thereof. In another preferred embodiment, the outer surface can be non-pebbled and generally smooth, without pebbles, a pebbled texture or other grains or projections. The cover strips 52 have a thickness measured in a direction extending radially from the center point 39 (FIG. 1) from the inner surface to the outer surface of the cover strip 52, and a width measured from the first side wall 58 to the second side wall 60. The cover strips 52 can be constructed in a manner similar to the cover panels 22. The cover strips 52 can be formed of a single layer of material similar to that of the outer layer 30 of the cover panel 22. Accordingly, the cover strips 52 can be formed of a wear-resistant, resilient material having a high coefficient of friction value (or a high level of grippability). The material used to produce the cover strip 52 can be a natural rubber, a butyl rubber, natural leather, synthetic leather, a polyurethane, a thermoplastic material, a thermoset material, or other synthetic polymeric materials. In an alternative preferred embodiment, the cover strips 52 can also include a backing such as the backing 32 of the cover panels 22.

Figure 11:
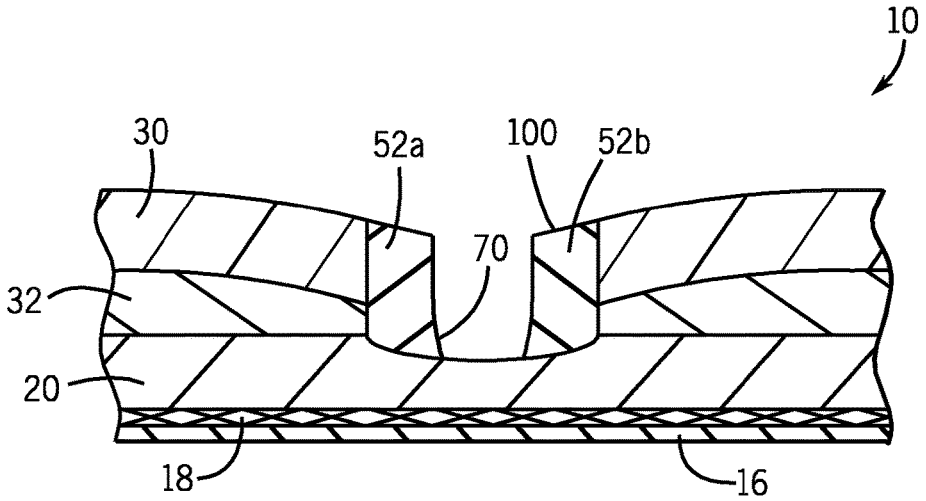
Figure 12:
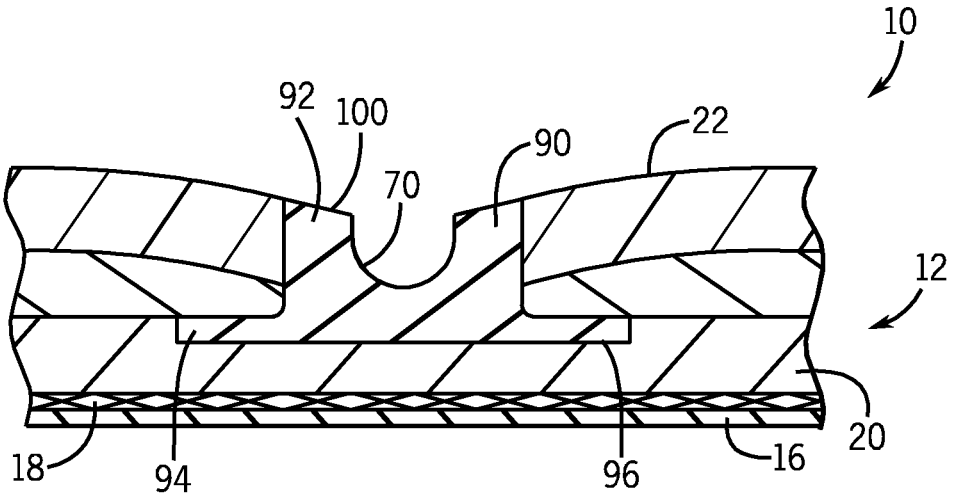

The cover strips 52 define at least one narrow elongate groove 70 in the outer surface 56 of the cover strip 52. The groove 70 can be substantially the same as the channel 40 and can be sized, shaped and positioned about the ball 10 in the same manners as described above with respect to the channel 40 above. All of the disclosure recited above with respect to the channel 40 is applicable to the groove 70. The groove 70 has a width, Wg, that extends between 20 to 60 percent of the width of the cover strip, and has a maximum depth from the outer surface 56 of the cover strip 52 that is at least 50 percent of the maximum thickness of the of the cover strip 52. The depth of the groove 70 can extend up to the entire thickness of the cover strip 52. Referring to FIG. 11, in one preferred embodiment, the groove 70 can extend through the entire thickness of the cover strip 52 to the layer of elastomeric material 20. In this embodiment, the groove 70 can separate the cover strip 52 into two separate strip segments 52*a* and 52*b*. The strip segments 52*a* and 52*b* can be entirely separate elements or can be formed as a one piece strip at some points along the length of the cover strip 52 and at other locations along the length of the cover strip 52, the cover strip 52 can be spaced apart as the separate cover segments 52*a* and 52*b*.

Referring to FIGS. 10 and 11, like the ribs, the elongated cover strips 52 define a collective first total length and the groove 70 can be one or more grooves that define a second collective total length. The second total collective length is at least 20 percent of the first total length. In another preferred embodiment, the cover strips 52 form a collection of channels forming a pattern, such as the pattern of a conventional basketball, and at least one of the grooves 70 is formed in each of the cover strips 52 of the set. In another preferred embodiment, the grooves 70 extend along approximately the entire length of the cover strips 52. In other preferred embodiments, the grooves 70 can be formed along the outer surface 56 of the cover strip 52 in a spaced apart manner or pattern. For example, each groove 70 can have a length of 2 inches and are defined in the cover strip 52 in an end to end fashion spaced apart by at least 0.5 inch. Other lengths, patterns and amounts of spacing between the plurality of grooves formed into the cover strips can also be used, and are contemplated in the present invention.

Unlike the ribs 24 of the above-disclosed embodiments, the cover strips 52 are preferably not molded as part of the carcass 12. Rather, the cover strips 52 are preferably applied to the ball 10 after the carcass 12 is removed from the carcass forming mold. Accordingly, the cover strips 52 are part of the cover assembly 14. The cover strips 52 are preferably bonded to the carcass 12 or to an intermediate layer in the manner similar to that of the cover panels 22. The cover strips 52 are preferably bonded through use of an adhesive to the first set of channels 50. Alternatively, the cover strips 52 can be attached to the carcass 12 at the first set of channels 50 through other means, such as an intermediate coupling layer, thermal bonding, chemical bonding or other conventional means.

The groove 70 meets the outer surface 56 of the cover strip 52 to form first and second edges 72 and 74. Third and fourth edges 76 and 78 are formed by the first and second side walls 58 and 60 meeting the outer surface 56 of the cover strip 52. The maximum thickness of the cover strip 52 can occur at the third and fourth edges 76 and 78. Preferably, the depth of the groove 70 is at least 50 percent of the thickness of the cover strip 52 at the third and fourth edges 76 and 78. The first, second, third and fourth edges 72, 74, 76 and 78 are preferably rounded. In other embodiments the first, second, third and fourth edges can be form non-rounded angled edges.

In alternative preferred embodiments, the position of the first, second, third and fourth edges 72, 74, 76, and 78 can be varied with respect to each other such that the outer surface 56 of the cover strip 52 can have a generally planar, flat or horizontal surface, or a sloped surface, or a curved surface, a concave surface, a convex surface or other curved surface. Like the channel 40, the groove 70 can be generally U-shaped or generally V-shaped, and its depth and/or width can be varied.

Referring to FIG. 11, in another alternative preferred embodiment, the cover strip can be a seam strip 90 that includes a raised central portion 92 positioned between a pair of flanges 94. The seam strip 90 is preferably an additional component comprising the carcass 12. The seam strips 90 can be applied over the layer of elastomeric material 20 before the components comprising the carcass 12 (in this embodiment, the bladder 16, the windings 18, the layer of elastomeric material 20 and the seam strips 90) are placed into the carcass-forming mold to produce the finished carcass 12. In a particularly preferred embodiment, a seam strip recess 96 is formed within the outer surface of the layer of elastomeric material 20 such that the flanges 94 layer flush with the outer surface 26 of the cover attachment regions 28. In an alternative preferred embodiment, the layer of elastomeric material 20 can be formed without a seam strip recess thereby allowing for the flanges to project outward form the outer surface 26 of the layer of elastomeric material 20. In this embodiment, the seam strips 90 can be applied before or after the carcass 12 is formed thereby being included as part of the carcass or applied to the outer surface of the completed carcass through use of an adhesive or other conventional attaching means.

The peripheral regions of the cover panels 22 extend over the flanges 94 and engage the sidewalls of the raised central portion 92 of the seam strip 90. The flanges 94 enable the seam strips 90 to be added as part of the molded carcass 12. The flanges 94 increase the width of the seam strip 90 and inhibit any portion of the layer of elastomeric material 20 from extending upward between the sidewall of the raised central portion 92 and the peripheral edges of the cover panels 22. Other than the flanges 94 and being preferably formed as part of the carcass 12, the seam strips 90 are substantially similar to the cover strip 52, including the configuration of the groove 70. The maximum depth of the groove 70 extends at least 70 percent of the height of the raised central portion 92 from the flanges 94, or at least 70 percent of the height of the sidewalls.

Figure 13:
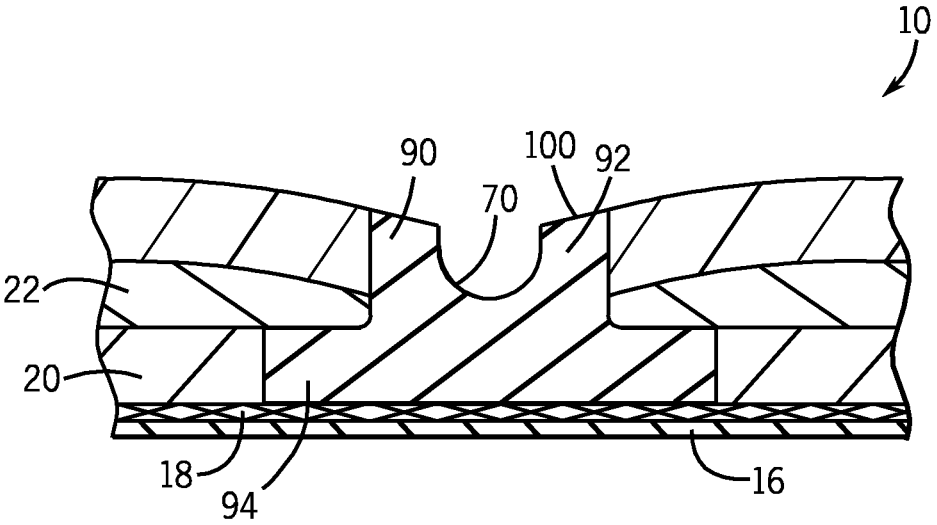

Referring to FIG. 13, in another alternative preferred embodiment, the seam strips 90 have an increased thickness such that the seam strip 90 is applied as part of the carcass 12 directly over the wound bladder and the layer of elastomeric material 20 is positioned on either side of the seam strip 90. The flanges 94 and the raised central portion 92 have an increased thickness such that each portion of the seam strip 90 extends inwardly to the windings 18. The peripheral edges or regions of the cover panels 22 extend over the flanges 94.

The embodiments of FIGS. 1-7 and 10-13 illustrate basketball configurations wherein the channel 40 or groove 70 is an additional recess in an existing wider, shallower recess 100. The contour of the central surface 34, and the outer surface 56 of the cover strips 52 and raised central portion 92 of the seam strip 90 define the shallow recess 100 that generally extends across the width of the central surface 34 and the outer surface 56. The central surface 34 and the outer surface 56 can be sloped or curved to provide the shallow, wide recess 100. The shallow, wide recess 100 can be further defined by skiving of the peripheral regions of the cover panels 22 adjacent the central surface 34 and the outer surface 56. The present invention adds a second narrow and deep channel 40 or groove 70 in addition to the existing shallow wide recess 100 thereby forming a dual recessed configuration that improves the feel and gripability of the ball 10.

Many embodiments of the basketballs 10 built in accordance with the present application are specifically configured for providing optimum performance in all levels of competitive, organized play. For example, many embodiments of the basketballs built in accordance with the present application fully meet the basketball rules and/or requirements of one or more of the following basketball organizations: the Basketball Rules of the National Federation of State High School Associations ("NFHS"); the Basketball Rules and Interpretations of the National Collegiate Athletic Association ("NCAA"); and the Official Basketball Rules of the Federation International de Basketball Amateur ("FIBA"). Accordingly, the term "basketball configured for organized, competitive play" refers to a basketball that fully meets the basketball rules and/or requirements of, and is fully functional for play in, one or more of the above listed organizations.

Basketballs built in accordance with the present invention can improve a player's ability to easily grasp, handle, pass, shoot, dribble and otherwise control the ball during use without radically departing from the ball's traditional design. The narrow, deep grooves and/or channels also facilitate a player's ability to impart spin on the ball during shooting. The improved maneuverability offered by the basketballs of the present invention can also assist in reducing turnovers.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A generally spherical basketball defining a center point, the basketball comprising:

a carcass having an outer surface defining a first set of channels and a plurality of cover panel regions between the first set of channels;

a plurality of cover panels respectively positioned over the plurality of cover panel regions and spaced apart from each other, the cover panels having peripheral edges; and a plurality of elongated cover strips positioned over the first set of channels and between the peripheral edges of the spaced-apart cover panels, the cover strips having inner and outer surfaces extending between first and second side walls, a thickness measured in a direction extending radially from the center point from the inner surface to the outer surface of the cover strip, and a width measured from the first side wall to the second side wall, at least one narrow elongate groove being formed into the outer surface of the cover strips, the groove having a width that extends between the range of 20 to 60 percent of the width of the cover strip and having a maximum depth from the outer surface of the cover strip that is at least 50 percent of the maximum thickness of the cover strip, the outer surface of the cover strip and the first and second side walls of the cover strip forming first and second edges, respectively, and the at least one elongate groove and the outer surface of the cover strip forming third and fourth edges, wherein the thickness of the cover strip at the first edge is greater than the thickness of the cover strip at the third edge, and wherein the thickness of the cover strip at the second edge is greater than the thickness of the cover strip at the fourth edge.

2. The basketball of claim 1, wherein the plurality of elongated cover strips define a collective first total length and wherein the at least one elongate groove defines a collective second total length that is at least 20 percent of the first total length.

3. The basketball of claim 2, wherein the plurality of elongated cover strips is a collection of interconnected cover strips, and wherein the at least one elongate groove is formed in each of the interconnected cover strips.

4. The basketball of claim 3, wherein the second total length is substantially the same as the first total length.

5. The basketball of claim 1, wherein one or more of the first, second, third and fourth edges are rounded.

6. The basketball of claim 1, wherein the cover panels are attached to the outer surface of the carcass at the cover panel regions.

7. The basketball of claim 1, wherein the cover strips are formed at least in part of a synthetic leather.

8. The basketball of claim 1, wherein the cover strips are formed of at least a first material positioned at the outer surface of the cover strips, and wherein the first material is selected from the group consisting of a natural rubber, a butyl rubber, natural leather, a polyurethane, a thermoplastic material, and a thermoset material.

9. The basketball of claim 1, wherein the at least one groove forms a general U-shape when viewed from the perspective of a lateral cross-sectional view of the cover strip.

10. The basketball of claim 1, wherein the plurality of cover strips are adhesively bonded to the carcass.

11. The basketball of claim 1, wherein the outer surface of the plurality of cover strips has a pebbled texture.

* * * * *